United States Patent [19]

De Bresser et al.

[11] 4,040,706

[45] Aug. 9, 1977

[54] CONTACT STRIP

[75] Inventors: Gijsbert Frederik Maria De Bresser; Teunis Adrianus Kassenaar; Ludovicus-Gerardus Johannes Godefrida Veraa; Leon Pieter Weenink, all of Eindhoven, Netherlands

[73] Assignee: U.S. Philips Corporation, New York, N.Y.

[21] Appl. No.: 665,272

[22] Filed: Mar. 9, 1976

[30] Foreign Application Priority Data

Jan. 4, 1975 Netherlands ..... 7503831

[51] Int. Cl.[2] ..... H01R 13/58

[52] U.S. Cl. ..... 339/103 R; 339/218 R; 339/223 R; 339/275 R

[58] Field of Search ..... 174/135; 339/103 R, 339/103 M, 218 R, 218 M, 223 R, 275 R, 276 T, 220 R

[56] References Cited

U.S. PATENT DOCUMENTS

| | | | |
|---|---|---|---|
| 2,668,279 | 2/1954 | Epstein | 339/103 R |
| 2,938,190 | 5/1960 | Krehbiel | 339/223 R |
| 3,885,849 | 5/1975 | Bailey | 339/103 R |
| 3,900,241 | 8/1975 | Fry | 339/218 M |

*Primary Examiner*—Roy Lake
*Assistant Examiner*—Mark S. Bicks
*Attorney, Agent, or Firm*—Frank R. Trifari; Rolf E. Schneider

[57] ABSTRACT

A contact strip comprising a support of synthetic material having a flat surface whereon linearly extending metal contact members are mounted by means of connection tags. These contact members are formed at one end as a pin contact or a socket contact and are provided at the other end with an insulated connection wire. The end of this wire has its insulation removed and is connected to the contact member. In order to avoid the necessity of a second connection between the contact member and the insulated portion of the wire, the contact member includes a U-shaped extension which partly encloses this insulated portion and presses this portion against the support.

4 Claims, 4 Drawing Figures

CONTACT STRIP

This invention relates to a contact strip comprising an electrically insulating support having at least one essentially flat surface on which a number of linearly extending metal contact members are anchored in a given position with respect to each other by means of connection tags formed on the contact members, each such contact member being formed as a pin contact or a socket contact at one end and being provided with an insulated connection wire at its other end, an end of the said connection wire having its insulation removed and being electrically and mechanically connected to the contact member.

For strain-relief of the connection between the connection wire and the contact member, a second mechanical connection is usually provided between this member and the still insulated portion of the connection wire in known contact members. This involves an additional step which has a cost-increasing effect. This invention has for its object to make this step superfluous, thus providing a less expensive contact strip. To this end, the contact strip according to the invention is characterized in that the contact member includes a U-shaped extension which encloses the portion of the connection wire which is still insulated, at least one connection tag being situated on the end of each leg of the U-shaped extension, the arrangement being such that the insulated end of the connection wire is located between the U-shaped extension and the surface of the support.

The support can consist of, for example, a flat wall which forms part of a larger construction, for example, a casing for an electronic device. In its simplest form, the support consists of a flat plate. If the support is made of a thermoplastic synthetic material, the connection tags can be embedded in the support by local heating. Such heating can be effected by any technique which is known per se, for example; by applying ultrasonic energy to the connection tags.

The invention will be described in detail hereinafter with reference to the drawings.

Figure 1:
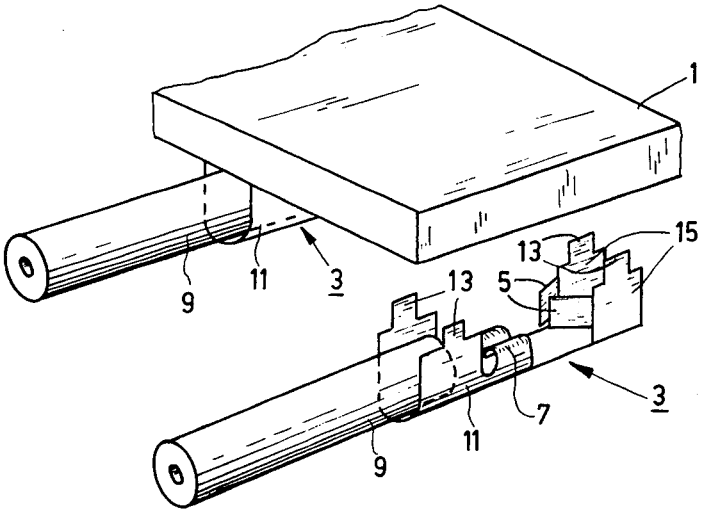
FIG. 1 is a perspective view of a first embodiment of a contact strip according to the invention in order to illustrate the principle.

The contact strip shown in FIG. 1 includes a support 1 of synthetic material in the form of a flat plate to which a row of contact members 3 is connected. The support can be formed, for example, by extrusion. FIG. 1 shows only one contact member 3 mounted on the support 1, and a contact member just before mounting. The contact member 3, in this example a socket contact member, is provided near one end with two leaf springs 5 which can co-operate with the pin of a pin contact member (not shown). An end of a connection wire 9 which has been stripped of insulation is electrically and mechanically connected to the contact member by a crimp connection 7 near the other end of the contact member. Other connection methods, for example, resistance welding are of course also possible. The contact member 3 furthermore comprises a U-shaped extension 11 which encloses the still insulated portion of the end of the connection wire 9 such that this portion is positioned between the U-shaped extension and the support 1. As a result, the crimp connection 7 is not loaded when the connection wire 9 is bent, so that a separate strain-relief for the crimp connection is not required; so making the device less costly. Finally, the contact member 3 comprises four connection tags 13, two of which are formed on the ends of the legs of the U-shaped extension 11, the other two tags being formed on two side plates 15 which also support the leaf springs 5. These connection tags serve to anchor the contact member 3 to the support 1. To this end, a thermoplastic synthetic material such as polyphenylene-oxide is chosen as the material for the support 1. The contact member 3 can then be pressed against the support by way of the connection tags 13, after which the connection tags are heated by a known method, for example, by applying ultrasonic energy or by induction heating of the contact member, such that the support material melts locally, so that the connection tags penetrate into this material and remain embedded therein after cooling. Obviously, there are also other known methods of so anchoring the connection tags.

Figure 2:
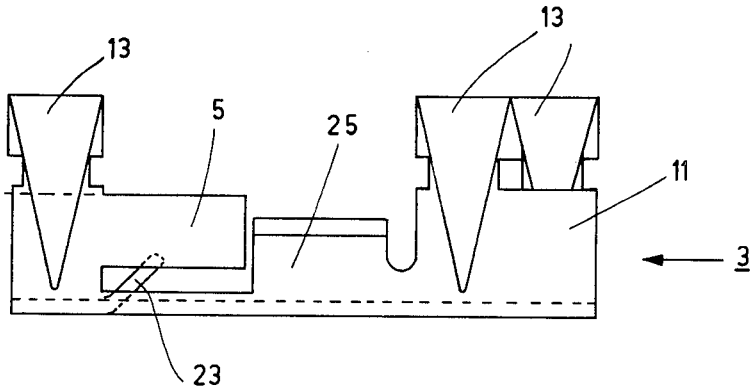
FIG. 2 is a side elevation of an embodiment of a contact member according to the invention.
Figure 3:
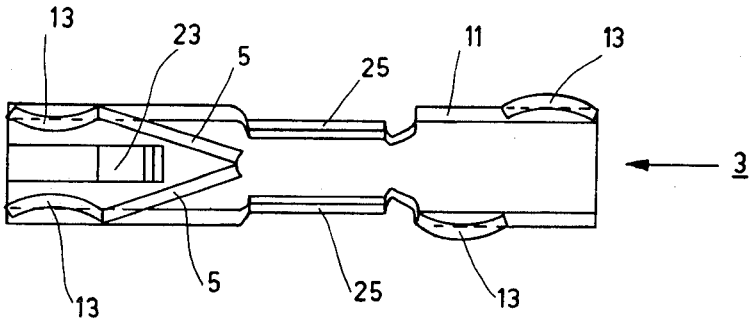
FIG. 3 is a plan view of the contact member shown in FIG. 2.

FIGS. 2 and 3 are a side elevation and a plan view, respectively, of a practical embodiment of a contact member 3, which comprises the same parts as the contact member shown in FIG. 1. The same reference numerals have been used for these parts. Furthermore, this contact member comprises a tag 23 which is bent upwards from the bottom and which positions an inserted connector pin (not shown) such that it will always be situated above the crimp connection 7 (see FIG. 1). As a result, the length of the contact member can be kept small. The crimp connection 7 is not yet present in FIGS. 2 and 3. It is realized in known manner by bending the flaps 25. For reinforcement, the connection tags are bent so as to be slightly concave as is clearly shown in FIG. 3.

Figure 4:
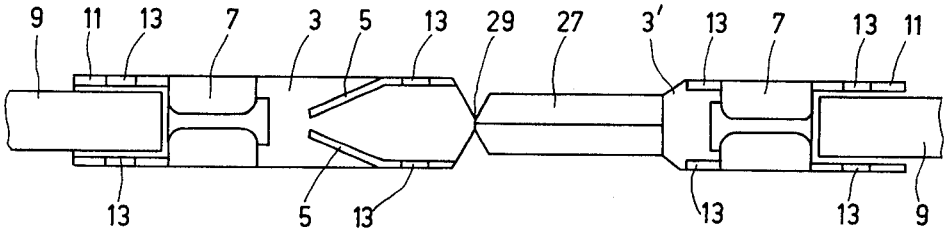
FIG. 4 shows a further embodiment in the form of two interconnected contact members including connection wires.

FIG. 4 shows two interconnected contact members 3 and 3′ formed from one piece of plate material. The contact member 3 is substantially identical to the member shown in FIG. 1, whilst the contact member 3′ deviates therefrom in that it comprises a pin contact member. To this end, the latter contact member comprises a connector pin 27 which has been folded from the plate material instead of the leaf springs 5. For the remainder the parts of the two contact members 3 and 3′ are identical. They are denoted by the same reference numerals as used in FIg. 1. The advantage of this construction is that two interconnected contact members can each be provided with a connection wire 9 which is connected on its other end to such a pair again, etc. The contact members provided with connection wires can thus be readily stocked. The two contact members can be separated from each other as desired at a suitably provided breaking area 29. The wire thus broken off has a contact member on both ends and offers, when it is cut in the middle, two contact members each provided with a connection wire. If the wire is not cut, the two contact members can be mounted on different supports so as to form two electrically interconnected contact strips. Obviously, depending on the need, the pairs of contact members can alternatively consist of two socket contact members or two pin contact members.

It will be clear from the foregoing that the contact strip according to the invention can be manufactured using a minimum amount of material and involving a minimum of cost. For some applications it could be a drawback that the contact members are not insulated from the surroundings. This drawback can be readily eliminated by arranging a cap of synthetic material (not shown) over the support 1 with the contact members 3, the said cap having cut-outs for the connection wires 9 and the connector pins to be inserted.

As has already been stated, the support may alternatively be a portion of another structure instead of flat plate. The support can also have a number of ledges, rather than a single level whereon the contact members are secured, each of the said ledges accommodating one or more contact members.

It has been found to be very advantageous in practice to manufacture and stock supports of a very long length and comprising very many contact members. A contact strip of a given length can be cut therefrom as desired.

We claim:

1. A contact strip comprising an electrically insulating support having an essentially flat surface, at least one linearly extending metal contact member mounted on said support by means of connection tags formed on said contact member, one end of said contact member being formed with first contact means for detachably mating with another contact means, and an insulated connection wire extending from the other end of said contact member, the end of said connection wire having its insulation removed and being electrically and mechanically connected to the contact member, said other end of the contact member including a U-shaped extension partly enclosing the insulated portion of the connection wire, each leg of said U-shaped extension being provided with one of said connection tags, the arrangement being such that the insulated portion of the connection wire is pressed by the U-shaped extension against the support surface.

2. A contact strip according to claim 1, in which the support is formed of a thermoplastic synthetic material, and the connection tags are embedded therein.

3. A contact strip according to claim 1, in which said first contact means comprises a pin contact.

4. A contact strip according to claim 1, in which said first contact means comprises a socket contact.

* * * * *